US008002485B2

(12) United States Patent
Eom

(10) Patent No.: US 8,002,485 B2
(45) Date of Patent: Aug. 23, 2011

(54) GUIDE APPARATUS FOR MOUNTING AND DISMOUNTING INNER PART AND IMAGE FORMING DEVICE HAVING THE SAME

(75) Inventor: Tae-won Eom, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 932 days.

(21) Appl. No.: 11/452,946

(22) Filed: Jun. 15, 2006

(65) Prior Publication Data

US 2007/0009309 A1 Jan. 11, 2007

(30) Foreign Application Priority Data

Jun. 29, 2005 (KR) ..... 10-2005-0057212

(51) Int. Cl.
*B41J 3/39* (2006.01)
*B41J 29/02* (2006.01)
*G03G 15/00* (2006.01)

(52) U.S. Cl. ..... 400/691; 400/693; 271/162; 271/164; 264/318

(58) Field of Classification Search ..... 400/691, 400/693; 271/162–164; 371/102; 264/239, 264/318

See application file for complete search history.

(56) References Cited

U.S. PATENT DOCUMENTS

| | | | | |
|---|---|---|---|---|
| 4,441,771 | A * | 4/1984 | Roesler | 312/322 |
| 5,273,272 | A * | 12/1993 | Nakamura et al. | 271/167 |
| 5,953,575 | A | 9/1999 | Park et al. | 399/401 |
| 6,941,093 | B2 | 9/2005 | Park et al. | 399/116 |
| 2004/0189163 | A1 * | 9/2004 | Liu et al. | 312/330.1 |
| 2005/0029324 | A1 | 2/2005 | Yoshie | 227/131 |
| 2005/0191091 | A1 * | 9/2005 | Isobe et al. | 399/119 |

FOREIGN PATENT DOCUMENTS

| | | | |
|---|---|---|---|
| JP | 05253978 | * | 3/1992 |
| JP | 8-324860 | | 12/1996 |
| JP | 2000052384 | * | 2/2000 |
| JP | 2004-46185 | | 2/2004 |
| JP | 2004-123393 | | 4/2004 |
| KR | 1999-1033 | | 1/1999 |
| KR | 1999-5173 | | 2/1999 |
| KR | 1999-14635 | | 5/1999 |
| KR | 1999-32073 | | 7/1999 |
| KR | 2004-66113 | | 7/2004 |
| KR | 2005-3876 | | 1/2005 |

OTHER PUBLICATIONS

Office Action issued in Korean Patent Application No. 2006-35935377 on Jun. 26, 2006.

* cited by examiner

*Primary Examiner* — Leslie J Evanisko
*Assistant Examiner* — Marissa L Ferguson-Samreth
(74) *Attorney, Agent, or Firm* — Staas & Halsey LLP

(57) ABSTRACT

A guide apparatus for mounting and dismounting an inner part usable in an image forming device includes: a first and a second sliders formed at both sides of a built-in part respectively; a first and a second undercut preventing parts formed at a first and a second side walls of the frame facing the both sides of the inner part under the connecting member, respectively; and a first and a second guide rails integrally formed with the first and the second side walls adjacent to the first and the second undercut preventing parts, respectively, and housing and guiding the first and the second sliders. Accordingly, the first and the second guide rails are integrally formed with the first and the second side walls of the frame, respectively, so that manufacturing is simpler, manufacturing costs and inferiority are reduced, and the intensity is increased.

10 Claims, 6 Drawing Sheets

GUIDE APPARATUS FOR MOUNTING AND DISMOUNTING INNER PART AND IMAGE FORMING DEVICE HAVING THE SAME

CROSS-REFERENCE TO RELATED APPLICATION

This application claims the benefit under 35 U.S.C. §119 (a) of Korean Patent Application No. 2005-57212, filed Jun. 29, 2005 in the Korean Intellectual Property Office, the disclosure of which is incorporated herein by reference.

BACKGROUND OF THE INVENTION

1. Field of the Invention

Aspects of the present invention relate to an image forming apparatus such as a laser printer and a duplicator. More particularly, aspects of the present invention relate to a guide apparatus for mounting and dismounting an inner part such as a paper counter-transfer guiding part of a duplexed printing unit with respect to a frame of a device body and an image forming device having the same.

2. Description of the Related Art

Generally, a duplex printing image forming apparatus, for example, a duplex printing laser printer 1, as illustrated in FIG. 1, includes a duplex printing unit 80 that re-inserts paper P, having one side already printed, into a developing unit 30 and a fixing unit 40 to have the paper P printed on the other side.

The duplex printing unit 80 includes a paper counter-transfer guiding part 62. The paper counter-transfer guiding part 62 is a part of a paper returning path B that allows the paper P having one side already printed to advance into the developing unit 30 and have the other side printed. A paper transfer direction switching part 54 switches the paper transfer direction when the paper P is move to the paper returning path B in a duplex printing operation.

The paper counter-transfer guiding part 62 includes first and second counter-transfer rollers 70, 90 to move the paper P through the paper returning path B. The paper counter-transfer guiding part 62 is formed to be mountable and dismountable with respect to a frame 14 (FIG. 2) inside a printer body 10 to allow for a removal of a paper jam. As such, the paper counter-transfer guiding part 62 is formed in a square housing, and the frame 14 of the printer body 10 has a first and a second guide rails 95 (the first guide rail being shown) formed in first inner and second inner side surfaces 16 (the first guide surface being shown) of the printer body 10 to guide respective lower parts of both sides of the paper counter-transfer guiding part 62.

The paper transmitting direction switching part 54 is arranged at the point where the paper transfer path A encounters the paper counter-transfer path B upstream of a discharge roller 60 of a discharge unit 50. In duplex printing operations, the paper transmitting direction switching part 54 rotates toward the position indicated in a solid line of FIG. 1 so as to guide the paper P, having one side printed, toward the paper counter-transfer path B in preparation of the paper P reentering the developing unit 30.

The conventional laser printer 1, constructed as is described above, includes the first and second guide rails 95 formed in the first and second side walls 16 as separate structures. The first and second guiding rails guide the paper counter-transfer guiding part 62 to be mountable and dismountable with respect to the frame 14 of the printer body 10, to allow for the removal of paper jams. That is, as illustrated in FIG. 3, a structure 16', such as the H-shaped frame 14, shown in FIG. 2, may not be separated from inner metallic patterns 97 after they are molded together, due to a protrusion 95', such as the guide rail 95, existing therein. That is, the structure 16' is designed to undercut the protrusion 95'. Accordingly, the inner protrusion 95', such as the guide rail 95, may not be integrally formed with the structure 16', but must be mounted therein as a separate part after the structure 16' is manufactured.

When the first and second guide rails 95 are mounted in the frame 14 as separate parts, one is required to separately mount the first and the second guide rails 95 in the first inner and second inner side surfaces 16 of the frame 14 by use of a fixing device such as a screw. Accordingly, manufacturing time and numbers of processes are increased, which leads to productivity deterioration and increases in manufacturing costs.

Also, when the first and second guide rails 95 are not precisely mounted in the frame 14 due to manufacturing errors of the fixing device, the paper counter-transfer guiding part 62, which is mounted along the first and the second guide rails 95, may not be precisely located. As such, the paper P, being counter-transmitted by the paper counter-transfer guiding part 62 in duplex printing operations, may suffer paper jams.

In addition, since the first and second guide rails 95 are mounted in the first and second side walls 16 of the frame 14 by the fixing device, a fixing part, such as a screw hole, must be made. Accordingly, a crack caused by manufacturing faults in the fixing part may be worsened by repeated mounting and dismounting operations of the paper counter-transfer guiding part 62 with respect to the. Also, the fixing parts may be damaged by shocks and as a result, escape from the first and the second side walls 16 or be forced away from the proper positions thereof, which may lead to malfunctions.

SUMMARY OF THE INVENTION

An aspect of the present invention provides a guide apparatus to mount and dismount an inner part in an image forming device and an image forming device having the same installed therein where guide rails are integrally formed with a frame. Accordingly, aspects of the present invention realize easy manufacturing processes, reduce manufacturing costs and inferiorities, and increase the printing quality.

According to an aspect of the present invention, the guide apparatus for mounting and dismounting an inner part of an image forming device, where the image forming device includes: a frame having first and second side walls, and a connection member connecting the first and second side walls; and at least one built-in part dismountably disposed under the connecting member. The guide apparatus for mounting and dismounting an inner part of an image forming device comprises: first and second sliders formed at both sides of a built-in part respectively; first and second undercut preventing parts formed at the first and the second side walls facing the both sides of the built-in part under the connecting member, respectively; and first and second guide rails integrally formed with the first and second side walls adjacent to the first and second undercut preventing parts, respectively, to house and guide the first and the second sliders.

According to an aspect of the present invention, the first and second sliders include at least one sliding protrusion rib protruding along both sides of the built-in part, respectively.

According to an aspect of the present invention, the first and second undercut preventing parts have at least one through hole at a predetermined horizontal length, respectively.

According to an aspect of the present invention, the first and second guide rails include at least one guide protrusion part formed under the through hole, the guide protruding part having an inner side having a height as long as or lower than that of a plane of a corresponding first or second inner side surface; and a horizontal guide surface disposed adjacent to the through hole to form a guide groove housing and guiding the corresponding first or second slider.

According to an aspect of the present invention, the inner side has the same horizontal length as that of the through hole, and the horizontal guide surface may be vertically formed on the inner side, at the same horizontal length as the horizontal length of the inner side.

According to an aspect of the present invention, the horizontal guide surface includes an inclining part downwardly inclining toward the external of the frame, so that the corresponding first or second slider can easily move inside the frame, along the guide rails.

According to an embodiment of the present invention, the frame includes a H-shaped or ⊏-shaped plate, and the inner part may include a paper counter-transfer guiding part of a duplexed printing unit having a transferring part moving paper through a paper counter-transfer path for paper printed at one side to re-enter into a developing unit, or a paper supply cassette carrying the paper.

According to another embodiment of the present invention, an image forming apparatus includes: a body having a frame including first and second side walls, and a connecting member connecting the first and second side walls; a duplex printing unit disposed in the frame and including a paper counter-transfer guiding part which has a transferring part to move paper during duplex printing operations to be positioned to re-enter a developing unit; and guide unit mounding and dismounting the paper counter-transfer guiding part with respect to the frame. The guide unit includes first and second sliders protruding from both sides of the paper counter-transfer guiding part, respectively; first and second undercut preventing parts formed in the first and the second side walls facing both ends of the paper counter-transfer guiding part, respectively, under the connecting member; and first and second guide rails integrally formed with the first and second side walls adjacent to the first and second undercut preventing parts, respectively, to house and guide the first and second sliders respectively.

According to an aspect of the present invention, the first and second sliders include at least one sliding protrusion rib protruding along both sides of the paper counter-transfer guiding part, respectively.

According to an aspect of the present invention, the first and second undercut preventing parts include at least one through hole at a predetermined horizontal length, respectively.

According to an aspect of the present invention, the first and second guide rails include at least one guide protrusion part formed under the through hole, the guide protruding part having an inner side having a height as long as or lower than that of a plane of a corresponding first or second inner side surface; and a horizontal guide surface disposed adjacent to the through hole to form a guide groove housing and guiding the corresponding first or second slider.

According to an aspect of the present invention, the inner side has the same horizontal length as that of the through hole, and the horizontal guide surface may be vertically formed on the inner side, at the same horizontal length as the horizontal length of the inner side.

According to an aspect of the present invention, the horizontal guide surface includes an inclining part downwardly inclining toward the external of the frame, so that the corresponding first or second slider can easily move inside the frame, along the guide rails.

According to an aspect of the present invention, the frame includes a H-shaped and/or ⊏-shaped plate.

Additional and/or other aspects and advantages of the invention will be set forth in part in the description which follows and, in part, will be obvious from the description, or may be learned by practice of the invention.

BRIEF DESCRIPTION OF THE DRAWINGS

The above aspects and/or other features and advantages of the present invention will become more apparent and more readily appreciated by describing in detail exemplary embodiments thereof with reference to the accompanying drawing figures, in which.

DETAILED DESCRIPTION OF THE EMBODIMENTS

Figure 1:
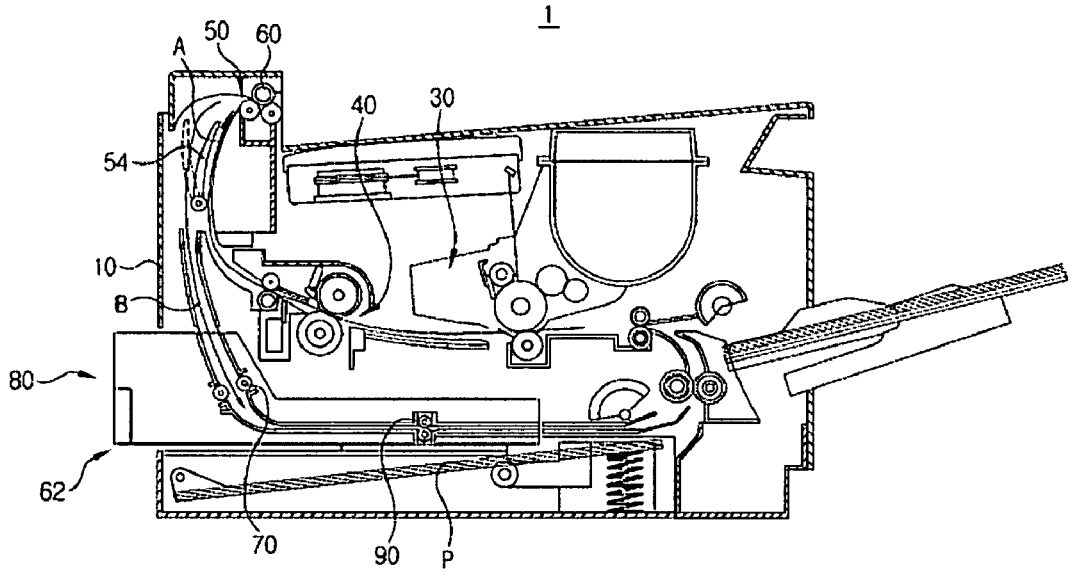
FIG. 1 (PRIOR ART)
FIG. 1 is a schematic diagram of a conventional duplexed printing laser printer.
Figure 2:
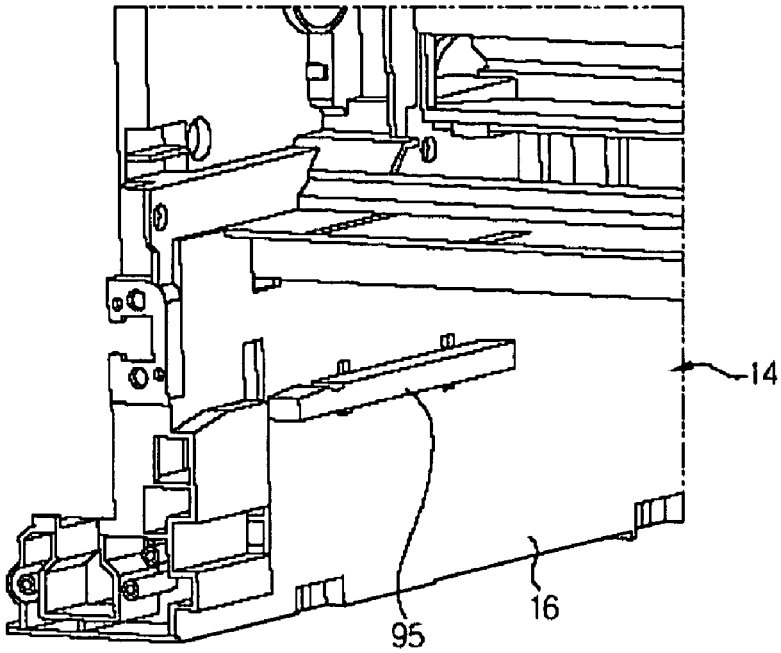
FIG. 2 (PRIOR ART)
FIG. 2 perspectively shows a guide rail of frame of the duplexed printing laser printer of FIG. 1.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 4:
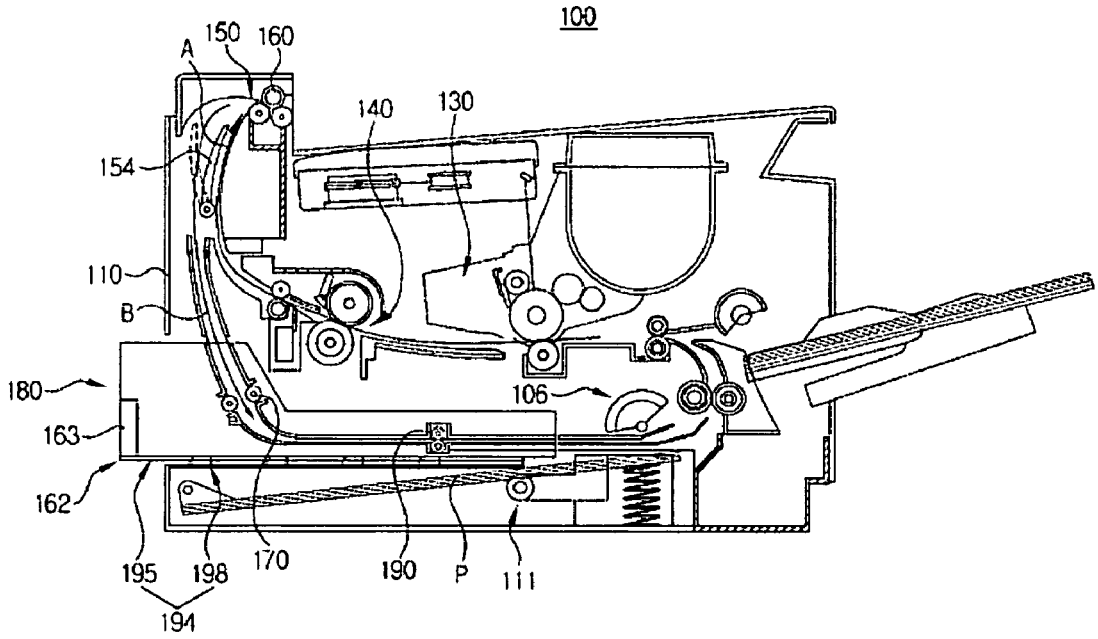
FIG. 4 schematically shows the duplexed printing laser printer having a guide unit in accordance with the present invention.

FIG. 4 schematically shows an image forming apparatus having a guide apparatus to allow for a mounting and dismounting of an inner part. The image forming apparatus having the guide apparatus may be a duplex printing laser printer 100 printing data received from an external device such as PC (personal computer).

As illustrated in FIG. 4, the duplex printing laser printer 100 includes: a paper supply cassette 111 that is mountable and dismountable to/from a frame 114 (FIG. 5) of a printer body 110, a picking-up and transferring unit 106 to pick up and transfer paper P loaded on the paper supply cassette 111; a developing unit 130 to form a toner image on the paper P; a fixing unit 140 to heat and press the toner image formed on the paper P, to fix as a visible image; a discharge unit 150 to discharge the paper P fixed with the visible image by the fixing unit 140; a duplex printing unit 180 having a paper counter-transfer guiding part 162 to cause the paper P, on which a printed image is printed on one side, to re-enter the developing unit 130 so as to have another image printed on the other side of the paper P; and a guide unit 194 to allow for the mounting and dismounting of the paper counter-transfer guiding part 162 on the frame 114.

While shown in the context of a laser printer, it is understood that aspects of the invention are usable in multi-function printers, copiers, facsimile machines, and in other types of printers beyond laser printers.

The duplex printing unit 180 includes a paper counter-transfer guiding part 162 as part of a paper returning path B along which the paper P travels in preparation of re-entering the developing unit 1309. A paper transfer direction switching part 154 switches the paper transfer direction so that the paper P moves to the paper returning path B in duplex printing.

The paper counter-transfer guiding part 162 includes first and second counter-transfer rollers 170, 190 to move the paper P through the paper returning path B. The paper counter-transfer guiding part 162 is dismountably disposed with respect to the frame 114 of the printer body 110 by the guide unit 194 to allow for a removal of a paper jam. As such, the paper counter-transfer guiding part 162 may be hexagon-shaped and may comprise a handling part 163 on an outer side thereof.

The paper transmitting direction switching part 154 is arranged at the point where the paper transfer path A encounters the paper counter-transfer path B upstream of a discharge roller 160 of a discharge unit 150. In duplex printing operations, the paper transmitting direction switching part 154 rotates to the position indicated in a solid line of FIG. 4 and guides the paper P to re-enter the developing unit 130.

Figure 5:
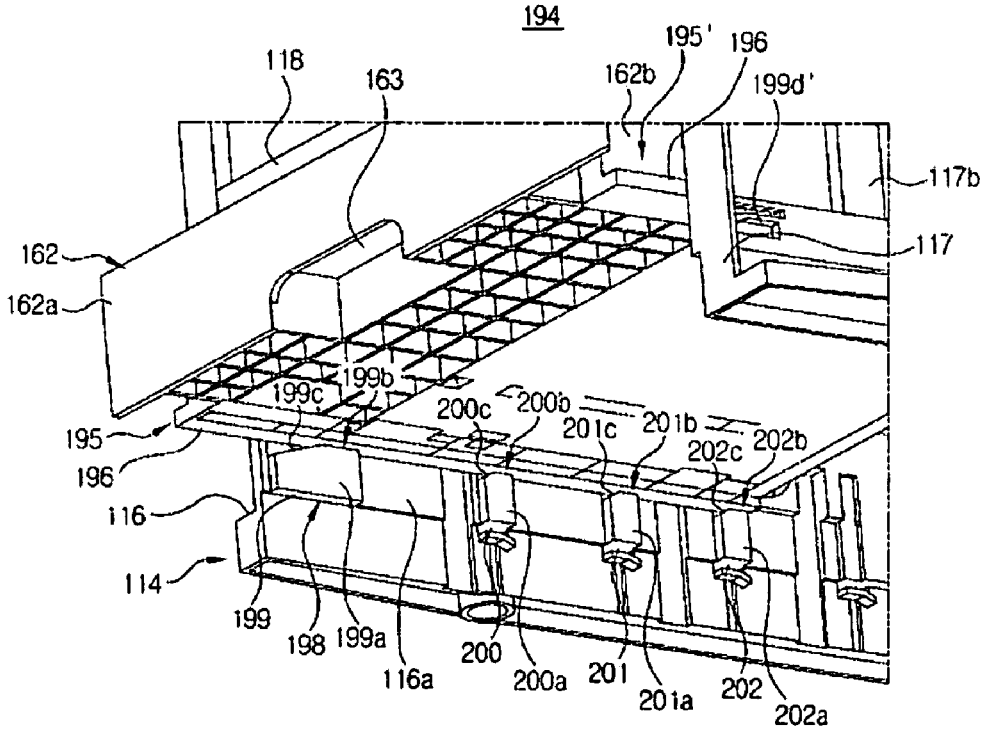
FIG. 5 perspectively shows that a paper counter-transfer guiding part of a duplexed printing unit is mounted on the duplexed printing laser printer of FIG. 4.
Figure 6A:
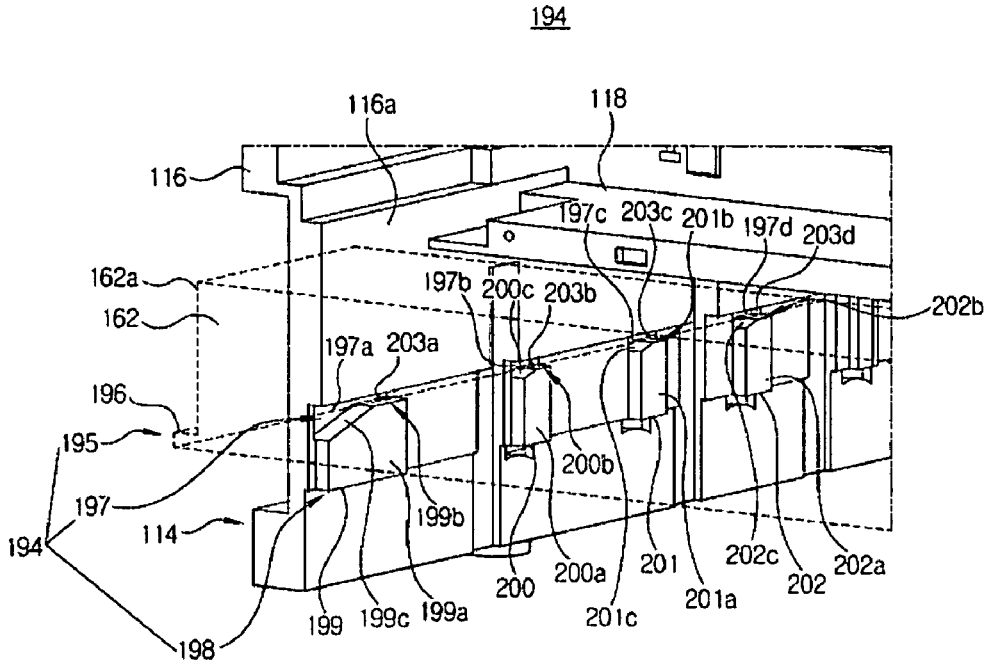
FIGS. 6A and 6B are a perspective and a side views of a first side wall integrally forming a first guide rail of the guide unit of the duplexed printing laser printer of FIG. 4.
Figure 6B:
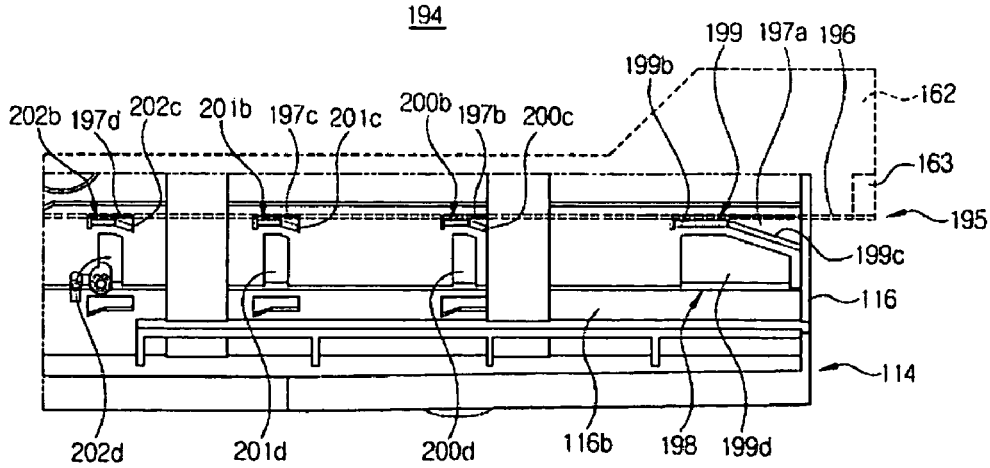

As shown in FIGS. 5, 6A and 6B, the guide unit 194 allows the paper counter-transfer guiding part 162 to be mounted on and dismounted from the frame 114 of the printer body 110, and includes: first and second sliders 195, 195'; first and second undercut preventing parts 197 (the first undercut preventing part, being formed at a first side wall 116, is shown, see FIG. 6A); and first and second guide rails 198 (the first guide rail, being formed on the first side wall 116, is shown, see FIG. 6A).

The frame 114, on which the paper counter-transfer guiding part 162 is disposed, comprises: first and second side walls 116, 117 (see FIG. 5); and a connecting member 118 horizontally connecting the first and the second side walls 116, 117. As such, the frame 114 forms a substantially H-shaped or ⊏-shaped plate.

Each of the first and the second sliders 195, 195' has a long sliding protrusion rib 196 horizontally protruding toward a lower part of both sides 162*a*, 162*b* (see FIG. 5) of the paper counter-transfer guiding part 162, respectively. The sliding protrusion rib 196 is inserted in and guided along guide grooves 203*a*, 203*b*, 203*c* and 203*d* (see FIG. 6A) formed between the first and the second side walls 116, 117 and horizontal guide surfaces 199*b*, 200*b*, 201*b* and 202*b* of guide protrusion parts 199, 200, 201 and 202 of the first and the second guide rails 198, which will be discussed hereinbelow.

The first and the second undercut preventing parts 197 (FIG. 6A) include 4 through-holes 197*a*, 197*b*, 197*c* and 197*d* horizontally formed at predetermined intervals at inner wall surfaces 116*a* (the inner wall surface of the first side wall is shown) of the first and the second side walls 116, 117 to face both sides 162*a*, 162*b* of the paper counter-transfer guiding part 162, respectively, under the connecting member 118. The 4 through-holes 197*a*, 197*b*, 197*c* and 197*d* are respectively formed with a predetermined horizontal length.

The through holes 197*a*, 197*b*, 197*c* and 197*d* remove the requirement that the first and the second guide rails 198 are to be undercut when the first and the second guide rails 198 are formed by inner metallic patterns 210 (see FIG. 7) in molding.

Figure 3:
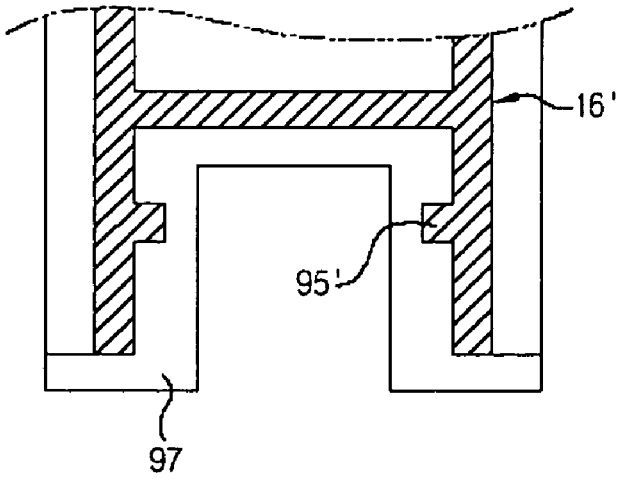
FIG. 3 (PRIOR ART)
FIG. 3 a partial diagram showing a problem of a structure having a protruding article inside, in molding.

In greater detail, as described with reference to FIG. 3, if the guide grooves 203*a*, 203*b*, 203*c* and 203*d* and the first and second guide rails 198 are all formed with inner metallic patterns 210 during the manufacture of the frame 114, the inner metallic patterns 210 will not be able to escape after molding, due to the first and second guide rails 198 being formed under the guide grooves 203*a*, 203*b*, 203*c* and 203*d*. Thus, the inner metallic patterns 210 should be designed for the first and second guide rails 198 to be undercut, so as to allow for a separation of the inner metallic patterns 210 from the frame 114 when molding is completed. Accordingly, the integrally formed frame 114 with the first and the second guide rails 198 cannot be manufactured in conventional methods. In order to solve the problem, according to an embodiment of the present invention, the guide grooves 203*a*, 203*b*, 203*c* and 203*d* are not formed with the inner metallic patterns 210, but, rather, with external metallic patterns 220 allowing for free movement of the inner metallic patterns 210.

Figure 7:
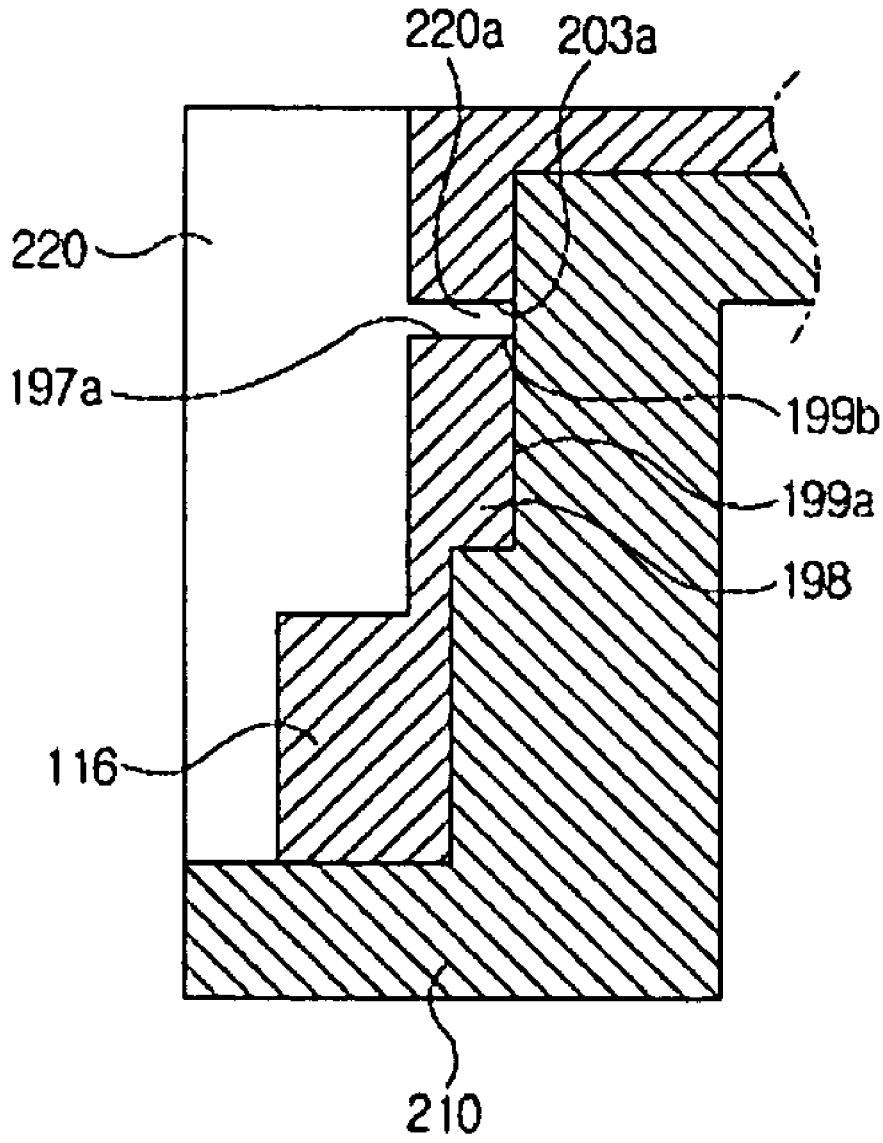
FIG. 7 partially shows an inner and an external metallic patterns molding the first guide rail of the guide unit of the duplexed printing laser printer of FIG. 4.

As is illustrated in FIG. 7, in order to form the guide grooves 203*a*, 203*b*, 203*c* and 203*d* in the external metallic patterns 220, a protruding part 220*a* of the external metallic patterns 220 shaped like the guide grooves 203*a*, 203*b*, 203*c* and 203*d* is extended to face the inner metallic patterns 210. Accordingly, the through holes 197*a*, 197*b*, 197*c* and 197*d* are formed by the protruding part 220*a* of the external metallic patterns 220 during molding.

The first and second guide rails 198 house and guide the sliding protrusion rib 196 of the first and second sliders 195, 195', respectively, and are formed integrally with inner side surfaces 116*a* of the first and the second side walls 116, 117 to face both sides 162*a*, 162*b* of the paper counter-transfer guiding part 162, respectively, under the connecting member 118.

The first and second guide rails 198 include 4 guide protrusion parts 199, 200, 201 and 202 that are pentagonally-formed, respectively, under 4 through-holes 197*a*, 197*b*, 197*c* and 197*d*. Each guiding protruding part 199, 200, 201 and 202 includes an inner side 199*a*, 200*a*, 201*a* and 202*a*, a horizontal guiding surface 199*b*, 200*b*, 201*b* and 202*b*, and an external side 199*d*, 200*d*, 201*d* and 202*d* (see FIG. 6B).

Each inner side 199*a*, 200*a*, 201*a* and 202*a* has a height less than or equal to than that of the inner wall surface 116*a* of the corresponding first or second side wall 116 or 117, and a horizontal length as long as that of the corresponding through hole 197*a*, 197*b*, 197*c* and 197*d*. The height restriction allows the inner metallic patterns 210 to escape by the inner side 199*a*, 200*a*, 201*a* and 202*a*, when the frame 114 is molded and the inner metallic patterns 210 are removed.

The horizontal guiding part 199*b*, 200*b*, 201*b* and 202*b* is located adjacent to the corresponding through hole 197*a*, 197*b*, 197*c* and 197*d* to form the guiding groove 203*a*, 203*b*, 203*c* and 203*d* housing and guiding the sliding protrusion rib 196 of the corresponding first or the second slider 195. The horizontal guiding part 199*b*, 200*b*, 201*b* and 202*b* has a horizontal length that is as long as that of the corresponding inner side 199*a*, 200*a*, 201*a* and 202*a*.

The horizontal guiding part 199*b*, 200*b*, 201*b* and 202*b* includes an inclining part 199*c*, 200*c*, 201*c* and 202*c* downwardly inclining toward the external of the frame 114, so that the sliding protrusion rib 196 of the corresponding first or second slider 195 may easily move inside the frame 114, along the corresponding first or the second guide rail 198.

As is illustrated in FIG. 6B, each external side 199*d*, 200*d*, 201*d* and 202*d* has a recess recessed from the external wall surfaces 116*b*, 117*b* of the corresponding first or second side wall 116, 117, to reduce molding materials.

The above structured guide unit 194 of the duplex printing laser printer 100 of the present invention has first and second guide rails 198 integrally formed with the first and second side walls 116, 117 of the frame 114, respectively, thereby not requiring that the first and second guide rails be separately manufactured. Accordingly, manufacturing is simpler, manufacturing costs are reduced and manufacturing inferiority caused by tolerances is decreased.

As is discussed above, the guide unit 194 of the duplex printing laser printer 100 of the present invention includes first and second guide rails 198 having 4 pentagonally-shaped guide protrusion parts 199, 200, 201 and 202, respectively. However, the first and the second guide rails 198 may have one long pentagonally-shaped guide protrusion part (not shown), to have the same constructions and operations as the guide protrusion parts 199, 200, 201 and 202.

The guide unit 194 of the duplex printing laser printer 100 is used to allow for a mounting and dismounting of the paper counter-transfer guiding part 162 of the duplex printing unit 180 with respect to the frame 114 of the printer body 110, but various changes in form and details may be made therein without departing from the spirit and scope of the invention as defined by the appended claims. That is, another built-in unit dismountably disposed with respect to the frame 114 of the printer body 110, for example a paper supply unit 111, may be applied with the same construction and principles.

Mounting and dismounting operations of the guide unit 194 of the duplex printing laser printer 100 of the present invention, structured as described above, will be described in detail with reference to FIGS. 4 through 6B.

In order to remove a paper jam, the paper counter-transfer guiding part 162 of the duplexed printing unit 180 is externally pulled from the printer body 110 by the handling part 163.

As the paper counter-transfer guiding part 162 is externally pulled out, the sliding protrusion rib 196 of the first and the second sliders 195 formed in both sides 162*a*, 162*b* of the paper counter-transfer guiding part 162 is slid along the horizontal guide surfaces 199*b*, 200*b*, 201*b* and 202*b* of the first and the second guide rails 198 through the guide grooves 203*a*, 203*b*, 203*c* and 203*d*.

The paper jam in the paper counter-transfer guiding part 162 may then be removed. Thereafter, to re-mount the paper counter-transfer guiding part 162 on the frame 114, the paper counter-transfer guiding part 162 is disposed such that front parts of the sliding protrusion ribs 196 of the first and the second sliders 195 are lined up with the inclining parts 199*c* of the horizontal guiding surfaces 199*b* of the first and the second guide rails 198, which are located close to the external side of the printer body 110.

In this state, the paper counter-transfer guiding part 162 is pushed by the handling part 163. As a result, each of the sliding protrusion ribs 196 of the first and the second sliders 195 is slid along the horizontal guide surfaces 199*b*, 200*b*, 201*b* and 202*b* of the first and the second guide rails 198 through the guide grooves 203*a*, 203*b*, 203*c* and 204*c*, until the paper counter-transfer guiding part 162 in completely inserted in the frame 114. Accordingly, the paper counter-transfer guiding part 162 is mounted on the frame 114 of the printer body 110.

As is discussed above, the guide apparatus to allow for a mounting and dismounting of an inner part of an image forming device and an image forming device having the same installed therein have first and second guide rails integrally formed with first and second side walls of the frame, respectively. As such separately fixing manufactured first and second guide rails is not required. Accordingly, manufacturing is simpler, manufacturing costs are reduced, manufacturing inferiority caused by tolerance is decreased and printing quality is increased.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A guide apparatus to allow for a mounting and a dismounting of an inner part of an image forming device, the image forming device including first and second side walls, a connection member to connect the first and second side walls, and at least one built-in part dismountably disposed under the connecting member, the guide apparatus comprising:

first and second sliders formed at sides of the built-in part;

first and second undercut preventing parts formed at the first and second walls, respectively, under the connecting member, facing the sides of the built-in part; and first and second guide rails integrally formed with the first and second side walls, respectively, adjacent to the first and second undercut preventing parts, to guide the first and second sliders, wherein at least one of the first and the second undercut preventing parts defines a through-hole, wherein each of the first and the second guide rails comprises at least one guide protrusion part formed under the defined through-hole, each guide protruding part comprising:

an inner side having a height less than or equal to that of a plane of a corresponding first or second inner side surface; and a horizontal guide surface, disposed adjacent to the through hole to form a guide groove housing, to guide the corresponding first or second slider.

2. The guide apparatus according to claim 1, wherein the inner side has a substantially similar horizontal length as that of the through hole, and the horizontal guide surface is vertically formed on the inner side, at a substantially similar horizontal length as the horizontal length of the inner side.

3. The guide apparatus according to claim 1, wherein each guide protrusion further comprises an inclined guide surface that extends downward from the horizontal guide surface, so that the corresponding first or second slider is able to move inside the frame, along the guide rails.

4. The image forming apparatus according to claim 1, wherein the first and second side walls and the connection member form an H-shaped or ⊏-shaped frame.

5. The image forming apparatus according to claim 1, wherein the inner part comprises at least one of a paper counter-transfer guiding part of a duplex printing unit having a transferring part to move paper through a paper counter-transfer path in duplex printing operations, and a paper supply cassette to carry the paper.

6. The image forming apparatus according to claim 1, wherein the through hole is substantially perpendicular to a plane defined by the side wall.

7. An image forming apparatus, comprising:

a body having a frame, including a first and a second side walls, and a connecting member to connect the first and the second side walls;

a duplex printing unit disposed in the frame and including a paper counter-transfer guiding part, which has a transferring part to move paper in duplex printing operations through a paper counter-transfer path to be positioned to re-enter a developing unit; and a mounting and dismounting unit to allow the paper counter-transfer guiding part to be mounted in and dismounted from the frame, the mounting and dismounting unit comprising:

first and second sliders protruding from both sides of the paper counter-transfer guiding part, respectively;

first and second undercut preventing parts formed in the first and the second side walls to face both ends of the paper counter-transfer guiding part, respectively, under the connecting member, at least one of the first and second undercut preventing parts defining a through-hole; and first and second guide rails, integrally formed with the first and the second side walls, adjacent to the first and second undercut preventing parts, respectively, to guide the first and the second sliders, respectively, wherein each of the first and the second guide rails comprises at least one guide protrusion part formed under the defined through-hole, the guide protrusion part comprising:

an inner side having a height less than or equal to than that of a plane of a corresponding first or second inner side surface; and a horizontal guide surface disposed adjacent to the through hole to form a guide groove to house and guide the corresponding first or second slider.

8. The image forming apparatus according to claim 7, wherein the inner side has the same horizontal length as that of the defined through-hole, and the horizontal guide surface is vertically formed on the inner side, at a substantially similar horizontal length as the horizontal length of the inner side.

9. The image forming apparatus according to claim 7, wherein the horizontal guide surface comprises an inclining part downwardly inclining toward an exterior of the frame, so that the corresponding first or second slider is able to move inside the frame, along the guide rails.

10. The image forming apparatus according to claim 7, wherein the frame includes a H-shaped or ⊏-shaped plate.

* * * * *